United States Patent [19]

Zoor

[11] 4,113,277

[45] Sep. 12, 1978

[54] SAFETY SKI BINDING

[75] Inventor: Reinhold Zoor, Dachau, Fed. Rep. of Germany

[73] Assignee: Heinrich Wunder KG, Fed. Rep. of Germany

[21] Appl. No.: 746,185

[22] Filed: Nov. 26, 1976

[30] Foreign Application Priority Data

Nov. 29, 1975 [DE] Fed. Rep. of Germany ..... 2553886
Feb. 28, 1976 [DE] Fed. Rep. of Germany ..... 2608322

[51] Int. Cl. ..... A63c 9/08
[52] U.S. Cl. ..... 280/626
[58] Field of Search ..... 280/623, 626, 632

[56] References Cited

U.S. PATENT DOCUMENTS 3,964,759 6/1976 Salomon ..... 280/626
3,970,326 6/1976 Salomon ..... 280/626

*Primary Examiner*—Robert R. Song
*Attorney, Agent, or Firm*—Peter K. Kontler

[57] ABSTRACT

A safety ski binding wherein the holding-down device for the heel of a ski boot constitutes the shorter arm of a two-armed bell crank lever the longer arm of which constitutes or carries one coupling element of a disengageable coupling. The other element of the coupling is provided on or forms part of a yoke which is pivotably mounted on a ski or on a part which is secured to the ski and is rigid with or movably supports a pivot member which defines for the bell crank lever an axis extending transversely of the skiing direction. The lever is pivotable about and is movable transversely of the axis of the pivot member, either with or relative to the pivot member. A helical expansion or compression spring is provided to oppose the disengagement of the coupling. Such disengagement takes place when the one coupling element is moved through a predetermined distance relative to the other coupling element, or vice versa, against the opposition of the spring; the shorter arm of the lever is then free to pivot away from the heel. The spring is located behind the pivot member, as considered in the skiing direction.

20 Claims, 10 Drawing Figures

SAFETY SKI BINDING

BACKGROUND OF THE INVENTION

The present invention relates to safety ski bindings in general, and more particularly to improvements in such portions of safety ski bindings which serve to secure the skis to the heels of ski boots or other articles of footwear. Still more particularly, the invention relates to improvements in safety ski bindings of the type wherein the holding-down device for the heel of a ski boot is pivotably and shiftably mounted in a yoke which is pivoted to the ski or to a part that is mounted on the ski, wherein the holding-down device is held in the operative position by a disengageable coupling, and wherein the coupling is automatically released or disengaged in response to the application of a predetermined force to thereby allow the holding-down device to become separated from the heel.

German Offenlegungsschrift No. 1,923,882 discloses a safety ski binding wherein the holding-down device for the heel of a ski boot is biased to operative position by a compression spring which extends rearwardly of the heel and wherein the holding-down device is pivotable about an axis that is normal to the skiing direction and is located at the rear end of the spring. The pivot member for the holding-down device is mounted in elongated slots which are provided in a housing for the spring; such pivot member extends laterally beyond the housing and is rigid with a yoke which, in turn, is pivotably secured to the ski. The housing is rigid with the holding-down device and has laterally extending projections which cooperate with brackets on the yoke in such a way that, when the holding-down device engages the heel, the housing is free to move transversely of the yoke but is unable to perform pivotal movements. The projections are disengaged from the brackets only when the holding-down device is subjected to a force whose magnitude warrants a disengagement of the holding-down device from the heel. The holding-down device is then free to pivot upwardly and away from the heel. The coupling (including the projections of the spring housing and the brackets of the yoke) is disposed between the holding-down device and the pivot member at the rear end of the spring; therefore, the part including the holding-down device and the spring housing must be located at one side (below) the dead-center position whenever the holding-down device properly engages the heel. Consequently, the coupling is subjected to very pronounced stresses which oppose the movement of projections relative to the brackets, or vice versa, and the magnitude of such stresses increases if the skier decides to increase the bias of the spring. This represents an unpredicatable factor which influences the operation of the coupling and can result in injury if the coupling is not disengaged in response to the application of a certain force which acts in a direction to detach the holding-down device from the heel. Another serious drawback of the just described conventional ski binding is that the extent to which the spring housing must move relative to the yoke depends on the selected bias of the spring and hence on selected magnitude of the force which is necessary to effect a separation of the holding-down device from the heel. This is due to the fact that the pivot member for the holding-down device is located behind the spring.

OBJECTS AND SUMMARY OF THE INVENTION

An object of the invention is to provide a safety binding for skis with a novel and improved mechanism which couples the ski to the heel of a ski boot or another article of footwear in such a way that the magnitude of the force which acts upon the coupling during automatic disengagement of the holding-down device from the ski boot or another article of footwear and/or the extent of movement of coupling elements relative to each other in order to allow for such automatic disengagement is not dependent on the magnitude of the stress which must be applied to cause a disengagement of the holding-down device from the heel.

Another object of the invention is to provide a mechanism of the above outlined character which is of simple, lightweight and compact construction, which can be used in all or nearly all types of ski bindings, and which can be readily adjusted to select the magnitude of the stress that is required to effect automatic disengagement of the holding-down device from the heel of a ski boot.

A further object of the invention is to provide a mechanism of the above outlined character which can be mounted directly on a ski, on a base plate which is affixed to a ski, or on another part of a ski binding, e.g., on a pivotable frame which supports the sole of a ski boot.

An additional object of the invention is to provide a mechanism, including a holding-down device for the heel of a ski boot, which can furnish indications of the selected bias of the spring which opposes detachment of the holding-down device from the heel and/or of the magnitude of force with which the holding-down device urges the boot forwardly.

The invention is embodied in a safety ski binding which comprises a yoke or stirrup pivotable with respect to the ski about an axis extending transversely of the skiing direction, pivot means provided in the yoke and extending in substantial parallelism with the pivot axis for the yoke (the pivot means may be rigid with or movable sideways in the yoke), a holding-down device which is movable about and in a direction substantially transversely of the axis of the pivot means to and from an operative position of engagement with the heel of a ski boot or the like, and disengageable coupling means for normally maintaining the holding-down device in the operative position. The coupling means comprises a first coupling element which is movable with the holding-down device about and in a direction substantially transversely of the axis of the pivot means, and a second coupling element (e.g., a pawl) on the yoke. The first coupling element is movable relative to the second coupling element from a first position of engagement with to a second position of disengagement from the second coupling element, and the binding further comprises a helical compression spring, a helical expansion spring or other suitable biasing means for urging the first coupling element to the first position to thus determine the magnitude of that force which is required to move the first coupling element to the second position. The biasing means is disposed behind the pivot means, as considered in the skiing direction.

The holding-down device preferably constitutes the shorter arm of a lever, most preferably a bell crank lever, whose longer arm supports or includes the first coupling element. The arms of the lever preferably make an obtuse angle.

The novel features which are considered as characteristic of the invention are set forth in particular in the appended claims. The improved binding itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
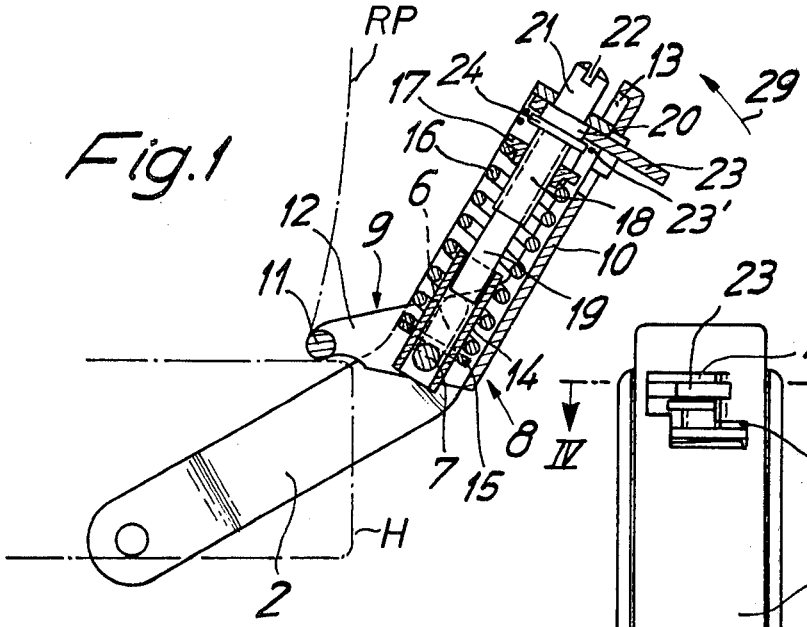
FIG. 1 is a longitudinal vertical sectional view of a portion of a safety ski binding which embodies one form of the invention, with the holding-down device shown in operative position.
Figure 4:
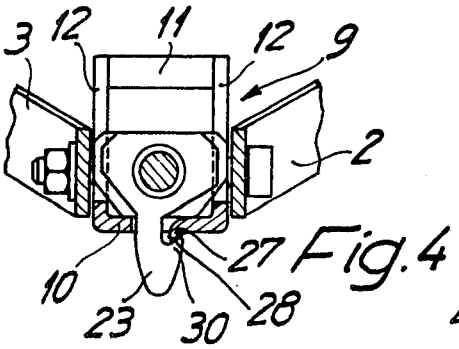
FIG. 4 is a sectional view as seen in the direction of arrows from the line IV—IV of FIG. 3.
Figure 3:
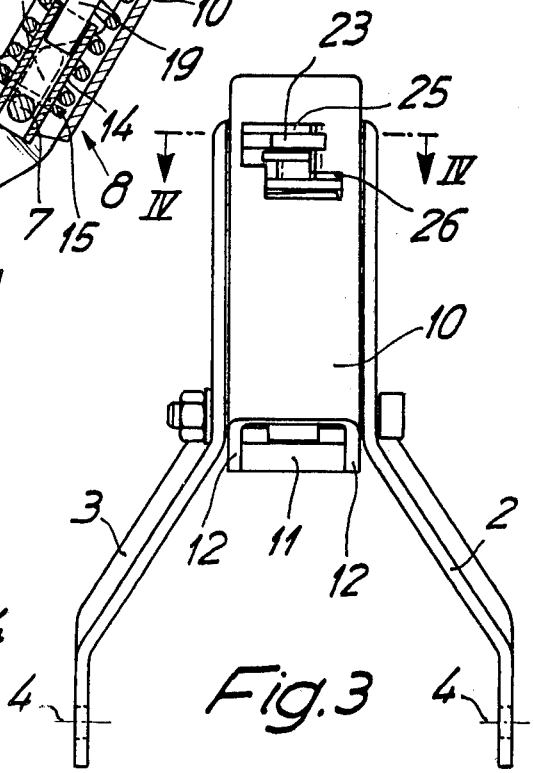
FIG. 3 is a view as seen from the right-hand side of FIG. 1.
Figure 2:
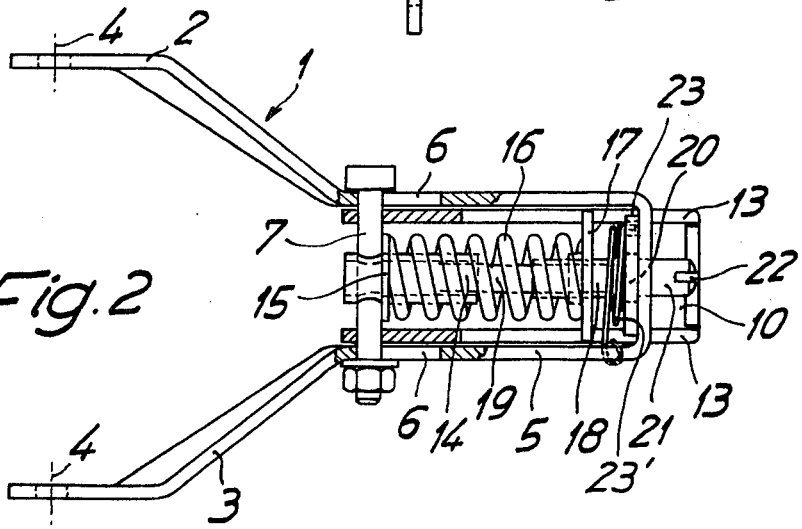
FIG. 2 is a plan view of the structure which is illustrated in FIG. 1, with certain parts shown in section.

Referring first to FIGS. 1 to 4, there is shown that portion of a safety ski binding which engages with and is adjacent the heel H of a ski boot. The heel H and the rear portion RP of a ski boot are indicated in FIG. 1 by phantom lines. The binding comprises a stirrup-shaped member 1 (hereinafter called yoke) having two spaced-apart legs 2 and 3 whose free ends are connected to a ski, to a base plate which is mounted on the ski, or to a frame of the safety ski binding. FIGS. 2 and 3 indicate, by phantom lines, a pivot axis 4 which is defined by the ski, by the base plate or by the frame and extends transversely of the skiing direction. FIG. 1 shows that such pivot is located forwardly of the rearmost portion and close to the underside of the heel H. The legs 2 and 3 of the yoke 1 converge toward each other in a direction toward the rear end of the ski and are integral with a housing 5 which is open at its front and rear ends. The housing 5 is inclined rearwardly and upwardly (see FIG. 1) so as to define with the plane of the legs 2 and 3 a relatively small acute angle, e.g., an angle of approximately 30°. When the illustrated portion of the safety ski binding engages the upper side of the heel H immediately behind the rear portion RP of the ski boot, the housing 5 and the upper side of the ski (not shown) make a relatively large acute angle, e.g., an angle of approximately 75°. It is assumed here that the thickness of the sole and heel H matches or approximates an average thickness.

The front portion of the housing 5 (i.e., that portion which is nearer to the rear ends of the legs 2 and 3) is formed with elongated guide slots 6 which are located diametrically opposite each other and receive the end portions of a horizontal pivot member 7 which is parallel to the axis 4 and may include a bolt whose head is outwardly adjacent one of the slots 6 and a nut which is outwardly adjacent the other slot 6. The pivot member 7 is connected to an intermediate portion of a slide 8 which is reciprocable in and turnable relative to the housing 5 of the yoke 1. The slide 8 is a bell crank lever having a shorter arm 9 which serves as a holding-down device for the heel H of a ski boot and a longer arm 10 a portion of which constitutes one element of a releasable coupling. The arms 9 and 10 of the slide 8 make a obtuse angle. The slide 8 is turnable on the pivot member 7 at the rear end of its shorter arm 9 which comprises two spaced-apart lugs 12 whose forward ends are connected to each other by a transversely extending cross bar 11 serving to directly engage the upper side of the heel H behind the rear portion RP of the ski boot. The rear portions of the lugs 12 merge into relatively narrow lateral reinforcing or stiffening ribs 13 of the longer arm 10.

The pivot member 7 extends through a transverse hole at the forward end of a bearing sleeve 14 which is disposed between the slots 6 of the housing 5 in the space between the reinforcing ribs 13 of the longer arm 10. The bearing sleeve 14 carries a washer-like retainer 15 for the foremost convolution of a helical compression spring 16 which is coaxial with the bearing sleeve and whose rearmost convolution bears against a second retainer 17 having a tapped bore for an adjusting screw 18. The front portion of the shank 19 of the screw 18 is without threads and is slidably telescoped into the bearing sleeve 14. When the heel H of the boot moves rearwardly (to the right, as viewed in FIG. 1), the shorter arm 9 of the slide 8 causes the pivot member 7 to move the bearing sleeve 14 toward the rear end of the housing 5 whereby the bearing sleeve moves relative to the shank 19 of the adjusting screw 18. The rear portion of the adjusting screw 18 has a collar 20 which is located in and abuts against the rear or upper end of the housing 5. A stub 21 of the adjusting screw 18 extends rearwardly beyond the collar 20 and has a transverse slot 22 which can receive the working end of a screwdriver, a portion of a coin or any other rudimentary tool which is utilized to adjust the bias of the spring 16. When the screw 18 is rotated, the threaded portion of its shank 19 causes the rear retainer 17 to move forwardly or rearwardly while the collar 20 continues to abut against the rear end of the housing 5.

As mentioned above, the longer arm 10 of the slide 8 constitutes or comprises one element of a releasable or disengageable coupling another element of which is a pawl 23. This pawl is turnable on but cannot move axially of the adjusting screw 18. As shown in FIG. 1, the upper or front portion of the pawl 23 surrounds the collar 20 and abuts against a flange 24 which holds it against axial movement in a direction toward the pivot member 7. When the arm 9 of the slide 8 engages the heel H, the pawl 23 extends outwardly through a first opening 25 which is provided in the median portion (coupling element) of the longer arm 10, i.e., in the portion disposed between the reinforcing ribs 13 (see FIG. 3), and allows the slide 8 to move relative to the pawl. The first opening 25 communicates with a second opening 26 which is also provided in the median portion of the longer arm 10. When the pawl 23 enters the second opening 26, the slide 8 is free to turn on the pivot member 7 in a direction to disengage the cross bar 11 of the shorter arm 9 from the heel H. FIG. 3 shows that the second opening 26 of the longer arm 10 is located forwardly of and at a level below the first opening 25. The pawl 23 is biased by a resilient element 23' here shown as a torsion spring which urges the pallet 30 of the pawl against the outwardly bent detent 27 at one lateral end of the first opening 25 (see particulary FIG. 4). The detent 27 has a suitably inclined surface 28 adjacent a complementary inner surface of the pallet 30 of the pawl 23. When the slide 8 is pivoted in the direction indicated by arrow 29 (FIG. 1), the surface 28 causes the pawl 23 to pivot anticlockwise, as viewed in FIG. 4, to thereupon enter the opening 25 and to finally engage the detent 27 under the action of the spring 23'. Since the pawl 23 surrounds the collar 20 and abuts against the flange 24, its axial position remains unchanged when the adjusting screw 18 is rotated in order to change the bias of the spring 16 by moving the retainer 17 toward or away from the retainer 15. Therefore, the distance which the pawl 23 must cover in order to move from the first opening 25 to the second opening 26 of the longer arm 10 remains unchanged, regardless of the selected bias of the spring 16. The heel H is released when the housing 5 moves relative to the adjusting screw 18, or vice versa, to such an extent that the pawl 23 enters the opening 26, i.e., that the pallet 30 slides along and beyond the detent 27. The slide 8 is then free to pivot clockwise, as viewed in FIG. 1.

An important advantage of the slide 8 is that its arm or holding-down device 9 is shorter than the arm 10 which includes one (25–27) of the coupling elements. This insures that the forces which act upon the coupling 23, 25–27 are practically independent of the selected bias of the spring 16. In fact, the forces which act upon the coupling are so small that the disengagement of coupling is not influenced by the magnitude of stresses upon the arm 9. In other words, friction between the elements of the coupling does not change in response to changes in magnitude of that stress which is required to effect automatic disengagement of the arm 9 from the heel H. The magnitude of forces acting upon the elements of the coupling is inversely proportional to the ratio of lengths of the arms 10 and 9, i.e., such forces are reduced if the length of the arm 10 relative to the length of the arm 9 is increased.

Another important advantage of the improved binding is that the shorter arm 9 of the slide 8 can be applied to the heel H with a minimum of effort. This is due to the fact that the pivot member 7 is mounted close to the heel, i.e., at the junction of the arms 9, 10 or in the shorter arm 9. Moreover, such mounting of the pivot member 7 (in front of the spring 16, as considered in the skiing direction) insures that the position of the slide 8 relative to the yoke 1 remains unchanged when the bias of the spring 16 is changed by means of the screw 18.

A further important advantage of the binding is that the slide 8 can constitute an extremely simple and lightweight component because it need not carry the spring 16. The spring 16 is mounted in the housing 5 of the yoke 1. Consequently, the mass of parts which move when the arm 9 is disengaged from the heel H is very small so that the binding need not be provided with a brake or other means for reducing the speed of and/or for limiting the extent of movement of the slide 8 upon disengagement of the coupling. Such brakes are needed in conventional bindings wherein the holding-down device forms part of a relatively heavy and bulky component which, if not braked upon disengagement of the holding-down device from the heel, is likely to strike against and to deface the ski.

Still another important advantage of the improved binding is that the arms 9 and 10 of the slide 8 make an obtuse angle, i.e., an angle exceeding 90°. This, in combination with the feature that the pivot member 7 is located close to or extends through the shorter arm 9, insures that the leverage favors the longer arm 10 which carries one element of the coupling. When the arm 9 properly engages the heel H, the longer arm 10 confines a portion of the spring 16, i.e., the longer arm can be said to form part of a composite spring housing which further includes the housing 5 of the yoke 1. This insures that the spring 16 is properly shielded and contributes to a reduction of the weight of the spring housing, a feature which is particularly important in bindins for cross country skis.

Friction between the elements of the coupling can be reduced still further (regardless of whether the spring which determines the force that is required to disengage the holding-down device from the heel is a compression spring or an expansion spring) by appropriate selection of the inclination of guide slots 6 in the housing 5. It is preferred to provide the housing 5 with slots which are parallel to the axis of the spring 16 and which make with the skiing direction (i.e., with the longitudinal direction of the ski) an angle greater than the angle between the common plane of the front portion (legs 2, 3) of the yoke 1 and the skiing direction. When the heel H is lifted, the pivot member 7 moves in the axial direction of the spring 16 so that its frictional engagement with the surfaces bounding the slots 6 is negligible. This can be readily achieved by appropriate selection of the inclination of such axis relative to the longitudinal direction of the ski.

The coupling including the pawl 23 and that portion of the arm 10 which is disposed between the ribs 13 constitutes a very simple, lightweight and reliable means for normally maintaining the holding-down device (arm 9) in requisite engagement with the heel H. When the stress which the heel applies to the cross bar 11 increases, the entire slide 8 simply moves toward the rear end of the housing 5 whereby the detent 27 slides along the pallet 30 of the pawl 23 and the pallet ultimately enters the second opening 26 which is offset relative to the opening 25 in such a way that the slide 8 is then free to turn about the axis of the pivot member 7 and the arm 9 can be disengaged from the heel.

Since the pivot member 7 is located in front of the spring 16, the adjustable retainer 17 can be located behind the spring, i.e., at the rear (upper) end of the housing 5. This renders it possible to mount the pawl 23 in such a way that it does not participate in axial movements of the retainer 17. Consequently, the distance which the arm 10 must cover in order to move its second opening 26 into register with the pawl 23 does not change when the user decides to change the bias of the spring 16 by moving the retainer 17 toward or away from the retainer 15. Pivotal mounting of the pawl 23 on the screw 18 (whose axial position relative to the housing 5 does not change when the retainer 17 moves in the axial direction of the spring 16) is preferred at this time because such mounting insures that the position of the pawl (as considered in the axial direction of the spring 16) is not dependent on the selected bias of this spring.

Moreover, and as already mentioned above, the placing of the coupling at a substantial distance from the pivot member 7 (i.e., from the shorter arm 9 of the slide 8) insures that friction between the elements of the coupling is not dependent upon (or is only negligibly influenced by) changes in the bias of the spring 16. Such friction is further reduced if the arm 10 is relatively long so that the pawl 23 is remote from the arm 9. It has been found that the combination of the just discussed features with the previously mentioned preferred inclination of the slots 6 relative to the longitudinal direction of the ski insures that the slide 8 exhibits a negligible tendency to turn about the pivot member 7 while it moves with the pivot member lengthwise of the slots 6, i.e., the force with which the pallet 30 engages the detent 27 is constant or nearly constant in all positions of the pivot member 7 relative to the slots 6. This holds true even if the bias of the spring 16 is increased considerably so that automatic disengagement of the arm 9 from the heel H necessitates the application of pronounced stresses.

The provision of an adjusting screw 18 whose shank 19 is long enough to be telescoped into the bearing sleeve 14 which carries the retainer 15 insures that the spring 16 cannot bulge laterally of the axis of the screw 18. Moreover, such mode of guiding the adjustable retainer 17 is simple because it necessitates the provision of a single additional part, namely the bearing member 14.

Figure 5:
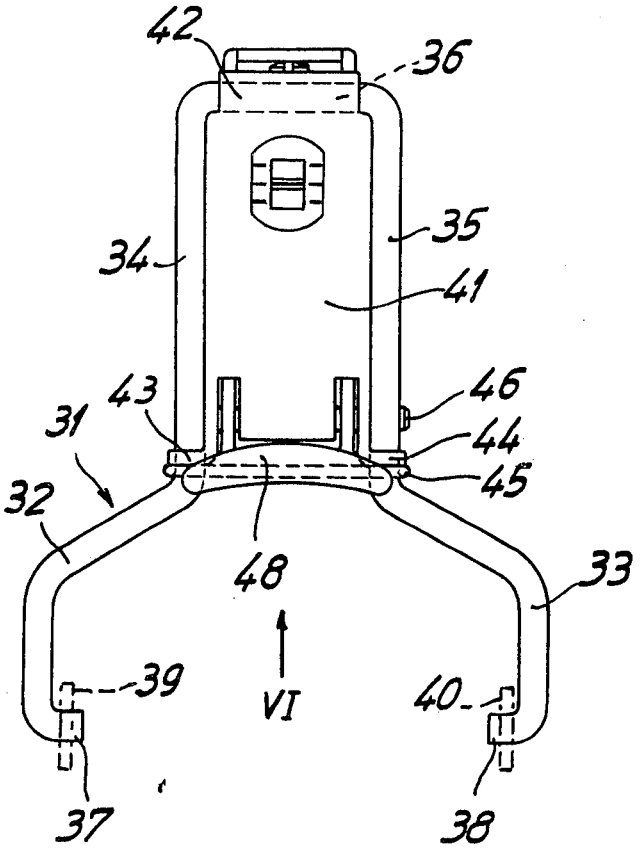
FIG. 5 is a plan view of a portion of a second safety ski binding.
Figure 6:
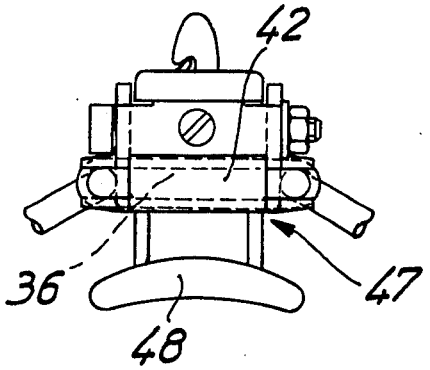
FIG. 6 shows a detail of the second binding as seen in the direction of arrow VI in FIG. 5.

FIGS. 5 and 6 show a portion of a second safety ski binding. In contrast to the structure of FIGS. 1 to 4, wherein the yoke 1 consists of flat bar stock, the yoke 31 of FIGS. 5 and 6 includes a suitably bent piece of thick wire having two substantially V-shaped legs 32, 33 and a pair of rearwardly and upwardly extending shanks 34, 35 which are parallel to each other. The rear end portions of the shanks 34, 35 are connected to each other by a traverse 36 of the yoke 31. The free front end portions 37, 38 of the legs 32, 33 are bent inwardly toward each other and extend into bearings 39, 40 here shown as eyelets which can form part of a ski, of a base plate or of a frame of the binding. The common axis of the bearings 39, 40 corresponds to the common pivot axis 4 for the legs 2, 3 of the yoke 1 shown in FIGS. 1 to 4. The yoke 31 further comprises a housing 41 which is disposed between the shanks 34, 35 and preferably consists of a piece of suitably deformed sheet metal. The means for fastening the housing 41 to the other parts of the yoke 31 comprises a sleeve 42 which surrounds the traverse 36 and two laterally extending ring-shaped portions 43, 44 which are integral with the housing and surround the adjacent front ends of the shanks 34, 35. A strap 45 is provided to surround the foremost portions of the shanks 34, 35 in order to prevent a spreading of the yoke, i.e., a movement of the legs 32, 33 away from each other. The rear portions of the legs 32, 33, which are respectively integral with the shanks 34, 35, make an obtuse angle.

The pivot member 46 for the slide 47 is mounted in the housing 41 substantially in the same way as described for the pivot member 7 and housing 5 of FIGS. 1 to 4. The shorter arm or holding-down device of the slide 47 has a traverse 48 which engages the heel of a ski boot (not shown) and is preferably coated with a suitable synthetic plastic material. All other parts of the binding shown in FIGS. 5 and 6 are identical with or analogous to the corresponding parts of the first binding. A portion of the pawl and the detent for its pallet are shown in the upper part of FIG. 6. The compression spring (corresponding to the spring 16 of the first binding) is confined in the housing 41.

FIGS. 7 to 10 show a portion of a third binding having a stirrup-shaped member or yoke 49 whose legs 52, 52′ have inwardly bent coaxial front end portions turnably received in bearings 50 which are mounted on the ski, on a base plate or on a frame forming part of a binding for use on cross country skis. The bearings 50 define for the yoke 49 a horizontal pivot axis which extends transversely of the skiing direction. The legs 52, 52′ converge toward each other in a direction toward the rear end of the ski and are integral with two parallel shanks 53, 53′ whose rear ends are integral with a traverse 54 of the yoke 49. The parts 53, 53′, 54 together constitute a substantially U-shaped rear portion of the yoke 49. The front portion 52, 52′ of this yoke is V-shaped. The angle between the legs 52, 52′ and the corresponding shanks 53, 53′ is preferably an acute angle, e.g., 45°. A pivot member 51 is rigid with the front end portions of the shanks 53, 53′ and extends in parallelism with the pivot axis which is defined by the bearings 50. The member 51 defines a pivot axis for a slide 55 which is a bell crank lever having a shorter arm or holding-down device 56 and a longer arm 57. The arms 56 and 57 make an obtuse angle. The arm 57 includes a hollow casing 58 whose underside is open and which confines a helical expansion spring 59 one end of which is secured to the pivot member 51 and the other end of which is attached to the upper or rear end of the longer arm 57. The lower end of the arm 57 (i.e., that end which is adjacent the shorter arm 56) has two aligned elongated open slots or sockets 60 for reception of the pivot member 51. The sockets 60 extend in the longitudinal direction of the longer arm 57; they enable the slide 55 to turn on the pivot member 51 as well as to move at right angles to the axis of the member 51 and against the opposition of the spring 59 in the event that the applied stress suffices to warrant a disengagement of the shorter arm 56 from the heel of a ski boot.

The means for securing the spring 59 to the rear or upper end of the longer arm 57 comprises an adjusting screw 61 which extends through the upper end of the casing 58 and mates with a nut 62 in the casing. The nut 62 is affixed to the uppermost convolution of the spring 59. By rotating the screw 61, one can move the nut 62 axially to thereby change the bias of the spring 59. The nut 62 carries an index or marker which is movable along a suitably graduated scale on a light-transmitting pane in a window 63 provided in the casing 58. This enables the person who manipulates the adjusting screw 61 to read the selected bias of the spring 59. The lower (forward) end portion of the spring 59 carries a second index or marker which is located behind a preferably graduated scale on a pane in a second window 64 of the casing 58. By reading the position of the index on the lower end of the spring 59, the skier can determine the magnitude of the force which the shorter arm 56 of the slide 55 applies against the heel in a direction to move the ski boot forwardly, i.e., toward the device which attaches the binding to the sole in front of the toe portion of the boot.

Figure 7:
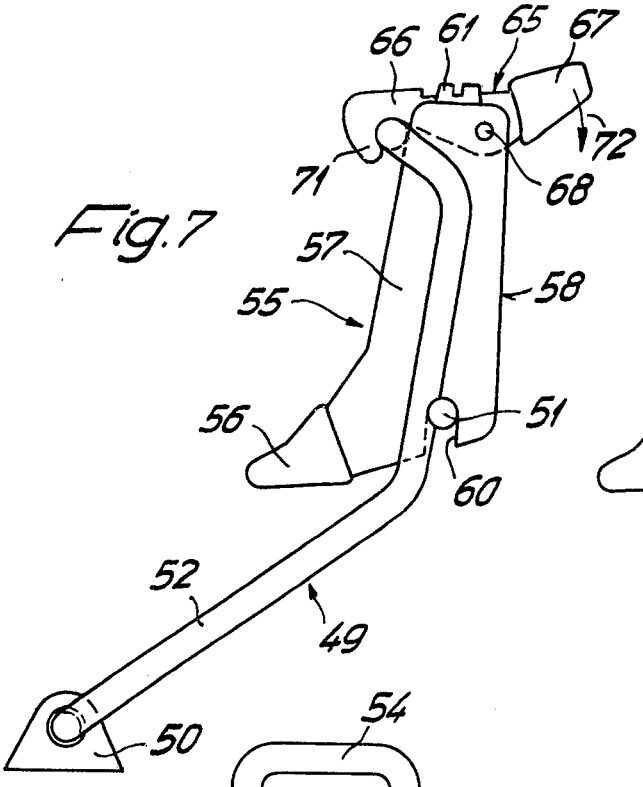
FIG. 7 is a side elevational view of a portion of a third safety ski binding.
Figure 8:
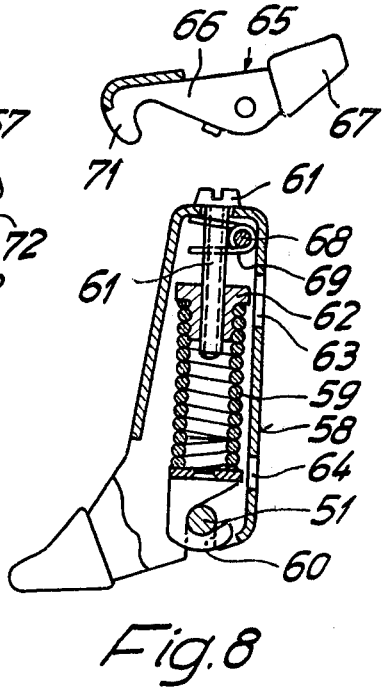
FIG. 8 is an exploded partly elevational and partly longitudinal vertical sectional view of certain parts of the structure shown in FIG. 7.
Figure 9:
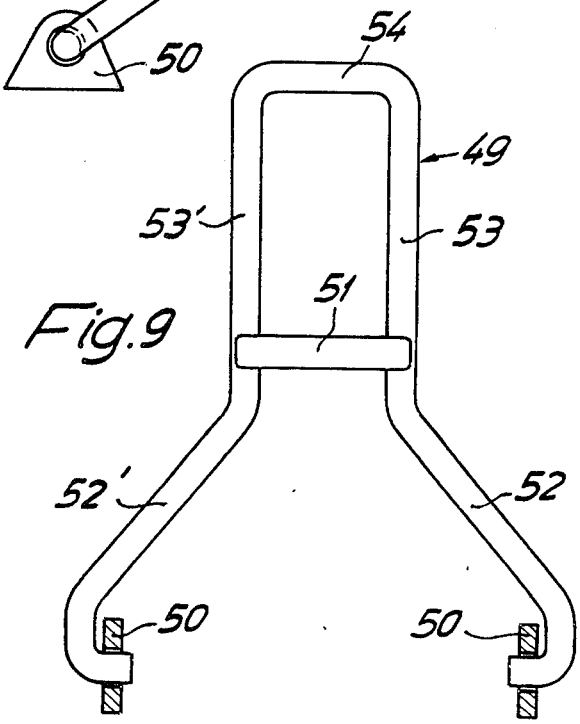
FIG. 9 is a plan view of a yoke which forms part of the structure shown in FIG. 7.
Figure 10:
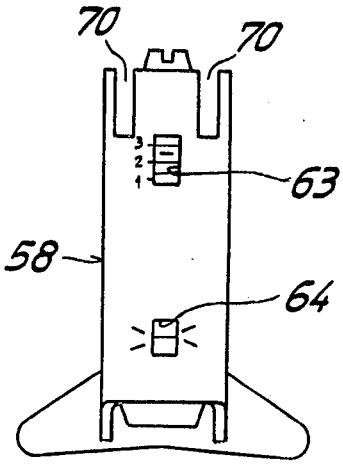
FIG. 10 is a rear elevational view of the part shown in the lower portion of FIG. 8.

The upper portion of the casing 58 further supports a two-armed coupling element or lever 65 which is pivotable on a horizontal shaft 68 and has a forwardly extending first arm 66 which constitutes a pawl having a pallet 71 and a rearwardly extending arm 67 which can be pivoted by hand or by a ski pole in the direction indicated by arrow 72 to thereby disengage the pallet 71 from the traverse (coupling element) 54 of the yoke 49. FIG. 7 shows that the upper end portions of the shanks 53, 53' are bent forwardly so that the traverse 54 is located in front of the common plane of the major (lower) portions of the shanks. The lever 65 is mounted at one side of the slotted head at the upper end of the adjusting screw 61. A torsion spring 69 is mounted in the casing 58 and serves to bias the lever 65 in a direction to maintain the pallet 71 in engagement with the traverse 54. It is preferred to use a twin lever 65 and to mount the two sections of such twin lever in discrete recesses or slots 70 provided in the upper part of the casing 58. When the pallets of such twin lever properly engage the traverse 54, the respective arms 66 of the twin lever preferably abut against the bottom surfaces of the slots 70 to insure that the lever 65 assumes the same angular position whenever the pallets 71 engage the traverse 54 under the action of the torsion spring 69. The two sections of the lever 65 are connected to each other by a web (shown in section in FIG. 8) above the pallets 71.

When the holding-down device or arm 56 of the slide 55 is subjected to the action of a certain force, the slide 55 moves upwardly and expands the spring 59 whereby the casing 58 moves relative to and transversely of the pivot member 51. When the casing 58 covers a predetermined distance, i.e., when the force acting upon the arm 56 reaches a certain magnitude, the casing 58 disengages the pallets 71 from the traverse 54 whereby the slide 55 is free to turn on the pivot member 51 in a clockwise direction, as viewed in FIG. 7, to disengage its shorter arm 56 from the heel. The skier can disengage the arm 56 from the heel by the simple expedient of pivoting the lever 65 in the direction indicated by arrow 72, i.e., such intentional disengagement of the arm 56 from the heel can be effected regardless of the magnitude of force which the heel exerts in a direction to move the slots 60 of the casing 58 relative to the pivot member 51.

The binding of FIGS. 7 to 10 also exhibits many important advantages. In this embodiment, too, the forces acting upon the coupling 65, 54 are not affected by the bias of the expansion spring 59. In other words, the magnitude of stress which is required to effect automatic disengagement of the heel from the shorter arm 56 of the slide 55 is not influenced by the coupling but depends solely upon the selected bias of the spring 59. As mentioned above in connection with the embodiment of FIGS. 1 to 4, friction between the elements of the coupling can be reduced still further by employing a slide wherein the arm 57 is much longer than the arm 56 so that the coupling can be installed at a considerable distance from the pivot member 51 and arm 56.

The provision of an expansion spring exhibits certain other important advantages. Thus, if the spring 59 accumulates snow and/or ice, such accumulations cannot influence the magnitude of the stress which is required for automatic disengagement of the arm 56 from the heel because automatic disengagement necessitates an expansion of the spring with the result that snow and/or ice becomes separated from (peels off) its convolutions. The likelihood of permanent accumulations of snow and/or ice in the interior of and/or on the convolutions of the spring is more pronounced if the spring is a compression spring. The provision of an expansion spring further exhibits the advantage that such spring can be confined in a very simple housing and need not be guided since it is always under tension. Consequently, the yoke 49 need not be provided with a spring housing because the simple shell or casing 58 of the longer arm 57 suffices to protect an expansion spring. The inclination of the axis of the spring 59 relative to the longitudinal direction of the ski and/or relative to the front portion (legs 52, 52') of the yoke 49 is preferably the same as described in connection with FIGS. 1 to 4. This also applies for the inclination of sockets 60, i.e., the sockets are preferably parallel to the axis of the spring 59; such inclination of the sockets insures that the movement of pivot member 51 relative to the slots 60 and/or friction between the elements of the coupling cannot affect the magnitude of the stress which is required to disengage the coupling against the opposition of the spring 59.

It is clear that the binding of FIGS. 1–4, and/or 5–6 may also comprise suitable means for allowing intentional disengagement of the coupling.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a safety ski binding, a combination comprising a yoke which is pivotable with respect to the ski about an axis extending transversely of the skiing direction; pivot means provided in said yoke and extending in substantial parallelism with said axis; a lever movable about and in a direction substantially transversely of said pivot means, said lever having a shorter first arm constituting a holding-down device movable to and from an operative position of engagement with the heel of a ski boot or the like and a longer second arm; disengageable coupling means for normally maintaining said device in operative position, including a first coupling element provided on said second arm and a second coupling element on said yoke, said first element being movable relative to said second element from a first position of engagement with to a second position of disengagement from said second element; and means for biasing said first coupling element to said first position to thus determine the magnitude of that force which is required to move said first element to said second position, said biasing means being disposed behind said pivot means, as considered in the skiing direction.

2. A combination as defined in claim 1, wherein said lever is a bell crank lever.

3. A combination as defined in claim 1, wherein said arms of said lever make an obtuse angle.

4. A combination as defined in claim 1, wherein said pivot means is located at or close to the junction of said arms.

5. A combination as defined in claim 1, wherein said yoke comprises a housing for said biasing means and said biasing means comprises a compression spring, said housing having guide means wherein said pivot means is movable sideways.

6. A combination as defined in claim 5, wherein said guide means is substantially parallel to the axis of said spring, said yoke further comprising a portion which is disposed between said housing and said first mentioned axis and makes with the skiing direction a first angle, said housing making with the skiing direction a second angle which is greater than said first angle.

7. A combination as defined in claim 5, wherein said second coupling element is pivotable with respect to said second arm and said first coupling element forms part of said second arm and has two communicating openings one of which receives said second coupling element in the first position and the other of which receives said second coupling element in the second position of said first coupling element.

8. A combination as defined in claim 7, further comprising a retainer for said spring, said retainer being mounted in said housing for movement in the axial direction of said spring and said second coupling element including a pawl pivotable about the axis of said spring, said retainer being movable axially of said spring independently of said pawl.

9. A combination as defined in claim 8, wherein said pawl is remote from said first arm.

10. A combination as defined in claim 8, further comprising means for moving said retainer in the axial direction of said spring, said pawl being pivotally mounted on said moving means.

11. A combination as defined in claim 10, further comprising a second retainer for said spring, said means for moving said first mentioned retainer being remote from said first arm and including an externally threaded member rotatably mounted in said housing and meshing with internal threads provided in said first mentioned retainer.

12. A combination as defined in claim 11, further comprising a bearing sleeve turnably mounted on said pivot means, said second retainer being secured to said sleeve and said threaded member having a portion which is slidably telescoped into said sleeve.

13. A combination as defined in claim 1, wherein said biasing means comprises an expansion spring, said pivot means being rigid with said yoke and said spring having a first end secured to said pivot means and a second end secured to said second arm at a location remote from said first arm.

14. A combination as defined in claim 13, further comprising means for movably securing said first coupling element to said second arm.

15. A combination as defined in claim 13, wherein said second arm comprises a casing for said spring and said casing has at least one elongated guide slot receiving said pivot means and permitting said arms to pivot about and to move transversely of said pivot means.

16. A combination as defined in claim 15, wherein said slot is substantially parallel to the axis of said expansion spring.

17. A combination as defined in claim 15, wherein said yoke comprises a portion located forwardly of said pivot means, as considered in the skiing direction, and making a first angle with the skiing direction, said slot making with the skiing direction a second angle which is greater than said first angle.

18. A combination as defined in claim 13, wherein said first coupling element comprises a pawl and further comprising means for pivotally securing said pawl to said second arm at a location remote from said first arm, said yoke having a portion which constitutes said second coupling element and is engaged by said pawl in said first position of said first coupling element.

19. A combination as defined in claim 18, wherein said first coupling element is a lever having a first arm which includes said pawl and a second arm which can be moved by the skier to disengage said pawl from said portion of said yoke.

20. A combination as defined in claim 1, wherein said biasing means comprises a spring, said pivot means being rigid with said yoke and said spring having a first end operatively associated with said pivot means and a second end operatively associated with said second arm at a location remote from said first arm.

* * * * *